US005224324A

United States Patent [19]

Granfelt

[11] Patent Number: 5,224,324

[45] Date of Patent: Jul. 6, 1993

[54] METHOD AND APPARATUS FOR REDUCING THE VOLUME OF A FLEXIBLE PACKAGE TO A MINIMUM AND A PACKAGE PROVIDED IN SUCH A WAY

[76] Inventor: Claes Granfelt, Källbacken 16, S-126 57 Hägersten, Sweden

[21] Appl. No.: 835,441

[22] PCT Filed: Aug. 21, 1990

[86] PCT No.: PCT/SE90/00538

§ 371 Date: Feb. 21, 1992

§ 102(e) Date: Feb. 21, 1992

[87] PCT Pub. No.: WO91/02681

PCT Pub. Date: Mar. 7, 1991

[30] Foreign Application Priority Data

Aug. 22, 1989 [SE] Sweden ..... 8902795

[51] Int. Cl.[5] ..... B65B 31/04

[52] U.S. Cl. ..... 53/436; 53/86; 53/526; 206/524.8

[58] Field of Search ..... 53/86, 405, 408, 403, 53/526, 523, 509, 427; 100/70 R; 206/524.8, 497, 803; 114/323, 324, 325, 376

[56] References Cited

U.S. PATENT DOCUMENTS

| | | | |
|---|---|---|---|
| 1,748,270 | 2/1930 | Antich | 114/323 |
| 2,780,043 | 2/1957 | Hensgen | 53/86 |
| 3,759,722 | 9/1983 | Simon | 206/524.8 X |
| 4,104,964 | 8/1978 | Larkworthy et al. | 53/526 X |
| 4,577,816 | 3/1986 | Foster | 206/524.8 X |
| 4,709,818 | 12/1987 | Spinosa et al. | 206/524.8 |
| 5,005,700 | 4/1991 | Rohling et al. | 206/524.8 X |

FOREIGN PATENT DOCUMENTS

| | | | |
|---|---|---|---|
| 2079683 | 1/1982 | United Kingdom | 114/376 |

*Primary Examiner*—James F. Coan

*Attorney, Agent, or Firm*—Hodgson, Russ, Andrews, Woods & Goodyear

[57] ABSTRACT

A flexible package (7) for rescue equipment and specially adapted to be mounted on the exterior of a craft of submarine type, the package being compressible round its contents so that it will take up a minimum volume. The method of compressing the package is performed in a pressure vessel (1) containing fluid (5) in which the package is immersed. The package has a connection with a nonreturn valve (9) which is connected to a tube (8) communicating with the surrounding atmosphere. Pressurizing of the package takes place through a three way valve (4), when the air contained in the package is pressed out through the conduit. On evacuation of the pressure vessel the nonreturn valve will close and the compressed volume of the package will remain.

6 Claims, 1 Drawing Sheet

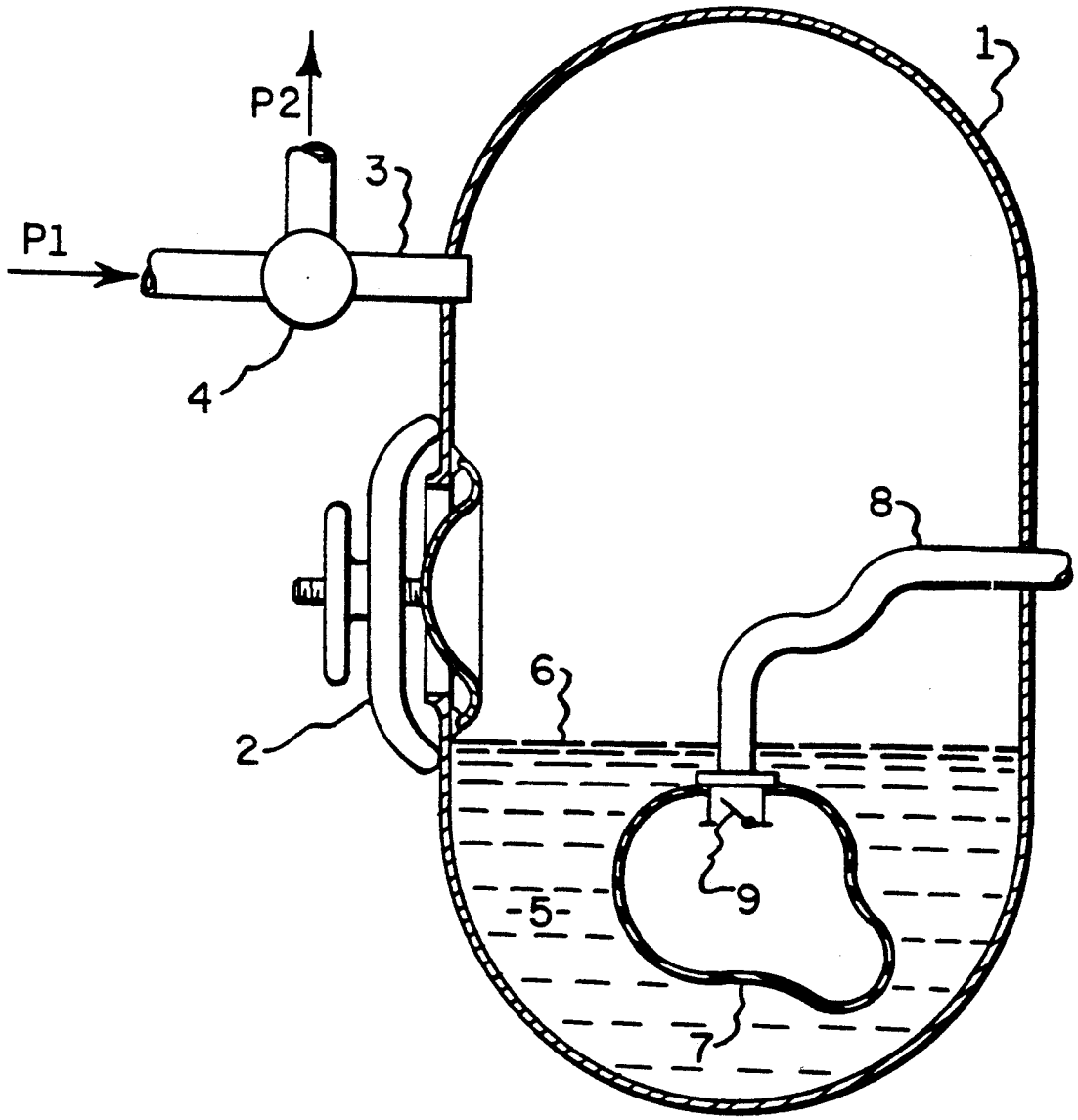
P2
P1
1
2
3
4
5
6
7
8
9

METHOD AND APPARATUS FOR REDUCING THE VOLUME OF A FLEXIBLE PACKAGE TO A MINIMUM AND A PACKAGE PROVIDED IN SUCH A WAY

TECHNICAL FIELD

The present invention relates to a method and an apparatus for reducing the volume of a flexible package and the contents contained therein to a minimum. This is done in a pressure vessel in which the package with contents is inserted through a sealable opening and which is provided with a pressure conduit for regulation of the inner pressure thereof. The invention is also concerned with a package provided in accordance with the method of the invention.

PRIOR ART

In the case of, for example, craft of the submarine type installation of easily accessible rescue equipment, such as lifeboats and the like, presents a problem. The equipment has commonly been installed near the exits of the craft. Since the area of the exits is limited, it is, however, difficult to bring the equipment out to the exterior of the craft, especially in emergency situations. It has also been suggested to dispose the equipment outboard. For this, however, separate pressure tanks have been required, in which the equipment is kept and which are independent of the pressures existing at different water depths to which the craft is capable of descending. From the point of view of design and operation, such separate pressure tanks obviously represent less satisfactory solutions.

DESCRIPTION OF THE INVENTION

By means of the present invention which relates to a flexible package for rescue equipment the above described problems will be eliminated. The package containing the rescue equipment is intended to be disposed on board or outboard, for example in close vicinity to the fin of the submarine. Owing to the package being flexible and having been given a minimum volume in accordance with the invention and adapted to the outlines of the rescue equipment, the equipment is capable of being kept in position independent of the depth reached by the craft. In this way, there is no risk of damage to the rescue equipment.

Thus, the rescue equipment is enciosed in a package the volume of which has been reduced to a minimum in that substantially all air contained in the package has been pressed out of the same by means of the method according to the present invention and an apparatus according to the present invention.

Methods and apparatuses for packaging articles under air pressure are previously known. Thus, for example, U.S. Pat. No. 2 780 043 describes a method and an apparatus for packaging edibles in evacuated packages by means of a pressure chamber. The pressure chamber is pressurized at the same time as the interior of the package contained therein is connected to a vacuum pump for evacuation of substantially all air.

According to a favourable embodiment of the method and of the apparatus according to the invention, compression of the package volume is carried out below the surface of a fluid contained in the pressure vessel. In this way, a good all-round effect on the package is achieved.

BRIEF DESCRIPTION OF DRAWING

The invention will hereinafter be described in more detail in conjunction with the drawing which illustrates a preferred embodiment of the invention.

The attached drawing is a schematic view of a pressure vessel 1 provided with a manhole cover 2 and a conduit 3 for regulation of the pressure in the pressure vessel 1. To the conduit 3 there is connected a three way valve 4. The pressure vessel 1 is partially filled with a fluid 5, preferably water.

In the figure of the drawing there is also shown a package 7 immersed below the surface 6 of the fluid 5, the interior space of the package communicating with the atmosphere surrounding the pressure vessel 1. Communication with the atmosphere takes place by means of a tube or hose pipe 8 which is connected to a nonreturn valve 9 on the package 7.

When compression of the volume of a flexible package 7 and the rescue equipment (not shown) enclosed therein is to be carried out, the three way valve 4 is adjusted such that the interior of the pressure vessel 1 will be connected to the surrounding atmosphere, as indicated by the arrow P2. The manhole cover 32 is open and the package 7 with rescue equipment is inserted in the pressure vessel 1 through the manhole. The pipe coupling with nonreturn valve 9 contained in the package 7 is connected to the tube 8. The package 7 is then immersed below the fluid surface 6 and the manhole cover 2 is applied. The three way valve 4 is readjusted for pressurizing of the pressure vessel 1 by means of a suitable pressure medium indicated by the arrow P1. The pressure medium may be, for example, air or nitrogen. Pressurizing is preferably carried out to a value which is higher than the pressure to be expected during later normal storing of the package on board a craft.

On pressurizing of the pressure vessel 1, the fluid 5 will be exerting an all-round pressure on the walls of the flexible package 7. The air enclosed in the package 7 will then be pressed out to the atmosphere surrounding the pressure vessel 1 through the nonreturn valve 9 and the tube 8. After a suitable pressure has been established in the pressure vessel 1 during a predetermined amount of time, the flexible package 7 will assume a minimum volume substantially corresponding to the rescue equipment (not shown) enclosed therein.

When the predetermined amount of time has passed or it has been established that air is no longer escaping from the tube 8, the three way valve 4 is readjusted to reconnect the interior of the pressure vessel 1 to the surrounding atmosphere (arrow 2). In connection with the fall of pressure in the pressure vessel 1, the nonreturn valve 9 will close and the compression of the package 7 achieved will remain. When the pressure in the pressure vessel 1 has fallen to atmospheric pressure, the manhole cover 2 is opened and the package is disconnected from the tube 8 and removed in its now compressed form. Another package may now be inserted in the pressure vessel 1.

While a special embodiment has been described above in connection with the drawing, it will be understood that the invention is not limited thereto. Various modifications may be made without departing from the idea of the invention. For example, the tube 8 may be provided with an outer valve making possible regulation of the gas connection between the package 7 connected and the atmosphere. Further, the fluid 5 may be a suitable fluid other than water.

The invention has been described above by means of examples with reference to use in craft. Other applications are possible, such as packaging of rescue equipment for aeroplanes where minimum volumes constitute an important condition.

Thus, the invention includes various alternative embodiments and is limited by the following claims only.

I claim:

1. A method of reducing the volume of a flexible package (7) and rescue equipment contained therein to a minimum, said method being performed in a pressure vessel (1), in which the package with the rescue equipment is inserted, characterized by raising the pressure in the pressure vessel (1) upon sealing of the vessel to a predetermined value which is higher than the pressure which may arise during later use, pressing the air enclosed in the flexible package (7) out through a connection (8) provided with a nonreturn valve (9) to the atmosphere surrounding the pressure vessel so as to achieve the minimum volume which is adapted to the outlines of the rescue equipment, and closing the nonreturn valve when the pressure of the pressure vessel is restored to normal atmospheric pressure so as to maintain the minimum volume.

2. A method according to claim 1, further characterized by immersing the package (7) with rescue equipment below the surface (6) of a fluid (5) contained in the pressure vessel prior to pressurizing the pressure vessel.

3. An apparatus for reducing the volume of a flexible package (7) and rescue equipment contained therein to a minimum, comprising a pressure vessel (1) with a sealable opening (2) for insertion of the package in the pressure vessel, a pressure conduit (3) for regulating the pressure in the pressure vessel, characterized in that the package (7) inserted in the pressure vessel (1) is connected to the atmosphere surrounding the pressure vessel through a nonreturn valve (9), whereby on pressurizing of the pressure vessel the air enclosed in the package is pressed out to the surrounding atmosphere, such that the package will take up a minimum volume adapted to be maintained by means of the nonreturn valve after the pressure in the pressure vessel has been restored to normal atmospheric pressure.

4. An apparatus according to claim 3, characterized in that the nonreturn valve (9) is disposed in the package (7).

5. An apparatus according to claim 3, characterized by a fluid (5) contained in the pressure vessel (1) and below the surface (6) of which the package (7) is immersed on pressurizing of the pressure vessel.

6. A package (7) of flexible material enclosing rescue equipment and adapted to be mounted, for example, on the exterior of a craft of the submarine type and having a minimum volume after treatment in a pressure vessel (1), characterized in that during said treatment the air contained in the package (7) before the treatment in the pressure vessel is pressed out through a connection with the atmosphere surrounding the pressure vessel, the connection being provided with a nonreturn valve (9), such that the minimum volume of the package is adapted to the outline of the rescue equipment and is maintained by closing of the nonreturn valve on completion of the treatment in the pressure vessel.

* * * * *